US005129578A

United States Patent [19]

Kokubo

[11] Patent Number: 5,129,578

[45] Date of Patent: Jul. 14, 1992

[54] USAGE OF CONDUCTIVE HEAT SOURCE GENERATED BY HEATING COMPRESSED AIR

[76] Inventor: Haruhiko Kokubo, 11-11, Kotobuki 1-chome, Taito-ku, Tokyo, Japan

[21] Appl. No.: 525,853

[22] Filed: May 21, 1990

[30] Foreign Application Priority Data

Mar. 22, 1990 [JP] Japan ..... 2-73070

[51] Int. Cl.[5] ..... F24D 5/00

[52] U.S. Cl. ..... 237/11; 237/1 R

[58] Field of Search ..... 237/11, 1 R; 126/247

[56] References Cited

U.S. PATENT DOCUMENTS 1,838,839 12/1931 Keichline ..... 237/11

*Primary Examiner*—Henry A. Bennet

*Attorney, Agent, or Firm*—Joseph C. Mason, Jr.; Ronald E. Smith

[57] ABSTRACT

Usage of a conductive heat source generated by heating compressed air, wherein compressed air obtained by compression by a compressor is sent into a compressed air heater having an electric heater incorporated therein, so as to be heated, and the compressed air thus heated is fed into a steel pipe arranged in a green house for forcing culture of vegetables or in other rooms, a compressed air exhaust port provided at the end of this steel pipe being inserted into a water tank so that, with the pressure of the compressed air inside the steel pipe always kept a little higher than the atmospheric pressure, a heat thus generated is conducted to the entire pipe wall of the steel pipe and radiated to inside of said room from this pipe wall to which the heat is conducted.

3 Claims, 1 Drawing Sheet

USAGE OF CONDUCTIVE HEAT SOURCE GENERATED BY HEATING COMPRESSED AIR

SUMMARY OF THE INVENTION

1. Field of the Invention

The present invention relates to usage of a conductive heat source generated by heating compressed air and, in particular, to a method of indoor heating.

2. Prior Art

For conventional indoor heating, the following three kinds of methods have been mainly adopted.

(1) A method wherein a heating appliance having structure capable of burning a fuel, such as oil, coal or gas, is employed and the air in a room is heated by flames of the fuel.

(2) A method wherein an electric stove, an electric heater or the like is employed and the air in the room is heated by the electric heat thereof.

(3) A method wherein hot water or steam is fed into a steel pipe arranged in the room so as to heat the steel pipe and the air in the room is heated by the surface temperature of the steel pipe.

According to the methods of (1) and (2) out of the above-stated conventional methods, a large quantity of heat calorie is necessitated until the entire air in the room is heated, while, according to the method (3), a long time is required until the entire air in the room is heated since the surface temperature of the steel pipe is low. Any one of the methods of (1) to (3), therefore, is accompanied by large consumption of fuel or electricity, which results in a shortcoming of a high cost of the fuel or the electricity. In the method of (1), in addition, a large quantity of oxygen is consumed together with an increase in a carbonic acid gas during the heating, which causes a shortcoming that not only the air in the room is fouled, but also a problem of air pollution is brought forth. In the method of (3), besides, a maximum temperature in the steel pipe is low and the rise of the surface temperature of the steel pipe is limited, which results in a shortcoming that an efficiency of a heat exchange with the indoor air is low.

The present invention is aimed at providing usage of a conductive heat source generated by heating compressed air, which, utilizes heated compressed air as the conductive heat source, heats the steel pipe arranged in a room to a high temperature therewith so that the inside of the room is heated by the surface temperature of the steel pipe, thus eliminating the shortcoming in the above-stated conventional methods of (1) to (3) once and for all.

The above-mentioned and other objects and features of the present invention will be seen in detail by considering the following description with reference to attached drawings which illustrate one example thereof.

DETAILED DESCRIPTION OF THE INVENTION

Figure 1:
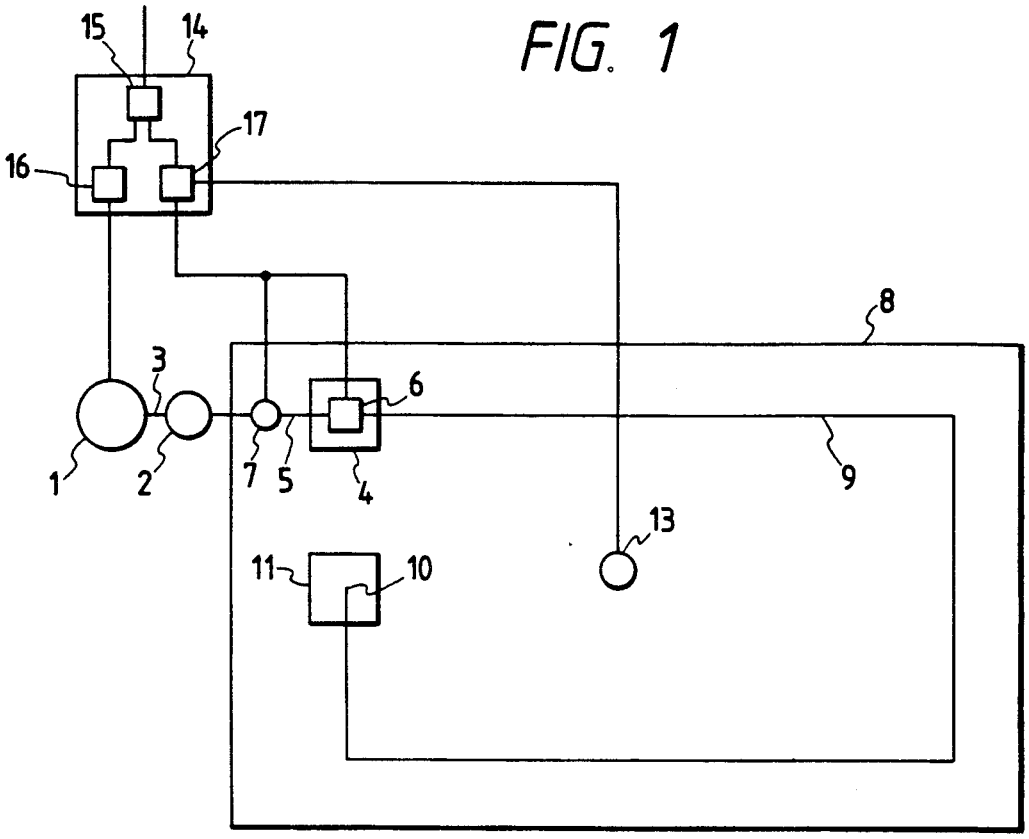
FIG. 1 illustrates schematically a construction of an apparatus embodying a method of the present invention.
Figure 2:
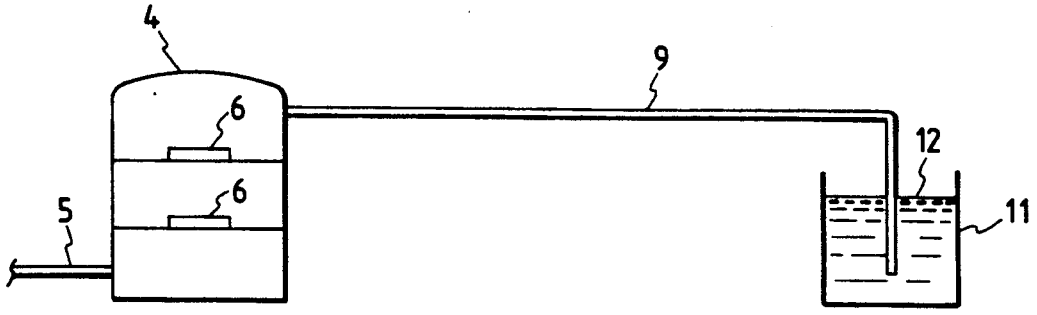
FIG. 2 illustrates one example of a piping through which heated compressed air is passed.

For the purpose of attaining the above-stated objects, the present invention is characterized in that:

(1) compressed air obtained by compression by a compressor is sent into a compressed air heater having an electric heater incorporated therein, so as to be heated, and the compressed air thus heated is fed into a steel pipe arranged in a green house for growing vegetables or in other rooms, a compressed air exhaust port provided at the end of this steel pipe is inserted into a water tank so that, with the pressure of the compressed air inside the steel pipe kept always a little higher than the atmospheric pressure, heat thus generated is conducted to the entire pipe wall of the steel pipe and radiated to inside of said room from this pipe wall to which the heat is conducted; i.e., to inside an enclosure;

(2) in the usage of the conductive heat source generated by heating the compressed air, described in the above item (1), the lower-limit and upperlimit temperatures of a temperature range set beforehand in the room are detected by a thermostat respectively and a solenoid valve provided in a supply route of the compressed air is controlled to open or close by each of detection signals thereof, while an electrification circuit to the electric heater in the compressed air heater is controlled thereby for connection or disconnection;

(3) in the usage of the conductive heat source generated by heating the compressed air, described in the above item (1) or (2), a steel pipe having the same diameter or a gradually enlarging diameter starting on the inlet side of the compressed air toward the exhaust side thereof is employed for the steel pipe arranged in the room; and (4) in the usage of the conductive heat source generated by heating the compressed air, described in the above item (1), (2) or (3), a steel pipe having heat-radiating fins on the outer periphery of the pipe wall is employed for the steel pipe arranged in the room.

In the usage of the conductive heat source generated by heating the compressed air, constituted as described above, the compressed air is prepared by the compressor and this compressed air is sent into the compressed air heater through an auxiliary tank. The compressed air sent into the compressed air heater in this way is brought into contact with and heated by the electric heater incorporated in the heater in a process of its passing through the heater in several seconds, and it is turned into heated compressed air wherein a large quantity of heat is accumulated. This heated compressed air is fed, as the conductive heat source, into the steel pipe arranged in the room. Since the compressed air exhaust port of the steel pipe is inserted into the water in the water tank at an appropriate depth, e.g. 1 meter, from the surface of the water, said heated compressed air can not pass through the steel pipe with one rush, but is exhausted gradually, in the form of bubbles, into the water in the water tank due to pressure difference between its pressure and a water pressure which acts to block up the compressed air exhaust port, and the heated compressed air of, e.g. about 2 barometric pressures, a little higher pressure than the atmospheric pressure stays in the steel pipe. In this state, the heat of the heated compressed air is conducted to the whole of the steel pipe and thereby the surface temperature of the pipe wall is made to rise. Moreover, the heated compressed air inside the steel pipe so acts as to expand the pipe wall of the steel pipe, while, at the same time, the pipe wall so acts as to resist the expanding action, and a frictional heat thus generated in the pipe wall facilitates the rise of the surface temperature of the pipe wall.

The heat is radiated into the air in the room from the entire surface of the steel pipe to which the heat is conducted in this way, so as to heat the inside of the room, or enclosure.

When the temperature in the room rises above the upper-limit temperature of a temperature range set beforehand, the thermostat installed in the room detects that and transmits a control signal to a controller for the solenoid valve and the electric heater. Therefore the solenoid valve closes and acts to stop the supply of the compressed air to the compressed air heater, while the electrification of the electric heater is discontinued simultaneously and consequently the electric heater acts to stop heating of the compressed air. When the temperature in the room falls below the lowerlimit temperature of the temperature range set beforehand, on the contrary, the thermostat installed in the room detects that and transmits a control signal to the controller for the solenoid valve and the electric heater. Therefore the solenoid valve opens and acts to start the supply of the compressed air to the compressed air heater, while the electric heater is electrified simultaneously and acts to start the heating of the compressed air.

EMBODIMENT

An embodiment of the present invention will be described hereunder on the basis of the drawings. Numeral 1 denotes a compressor, and 2 an auxiliary tank connected to the compressor 1 via a steel pipe 3. This tank serves to store temporarily the compressed air sent out from the compressor 1. Numeral 4 denotes a compressed air heater connected to the auxiliary tank 2 via a steel pipe 5, which has an electric heater 6 incorporated and is so formed as to have a capacity enabling the pressure reduction regulation of the compressed air sent thereinto through the steel pipe 5, so that the pressure is reduced a little. Numeral 7 denotes a solenoid valve opening and closing a supply route formed by the steel pipe 5, 8 a green house for growing vegetables, and 9 a steel pipe arranged in the house 8. The end part on the inlet side of this steel pipe 9 is connected to the compressed air heater 4, while a compressed air exhaust port 10 provided at the tail end of the pipe is inserted into water 12 stored in a water tank 11, at an appropriate depth, e.g. 1 meter, from the surface of the water. For this steel pipe 9, a steel pipe having the same diameter or a gradually enlarging diameter starting on inlet side of the compressed air toward the exhaust port side thereof is employed for facilitating the passing of the compressed air, and besides, a steel pipe having heat-radiating fins on the outer periphery of the pipe wall is employed for securing safety so that a person may not be burnt even when he touches the pipe wall. 13 denotes a thermostat provided in the house 8, and 14 a control panel which is provided with a ground fault circuit interrupter 15, a controller 16 connected to a circuit for electrification from the ground fault circuit interrupter 15 to the compressor 1 and controlling the compressor 1, and with a controller 17 which is connected to a circuit for electrification from the ground fault circuit interrupter 15 to the electric heater 6 and the solenoid valve 7 and makes a control to open or close the solenoid valve 7 on the basis a control signal from the thermostat 13, while making a control simultaneously to connect or disconnect the circuit for electrification to the electric heater 6.

When the steel pipe 9 is arranged in a spacious room, a heat pipe provided with an electric heater is joined to several places of the steel pipe 9 in some cases to supplement heating of the heated compressed air, and when the steel pipe 9 is so arranged as to offer sequential communication through the inside of the room divided into a plurality of sections, a heat pipe provided with the electric heater is joined to the steel pipe 9 in and for each section in some cases to supplement the heating of the heated compressed air.

The present invention can be embodied for heating the inside of various rooms and chambers besides the aforesaid green house 8.

EFFECT OF THE INVENTION

The present invention, constituted as described above, produces effects as in the following.

(1) Since the compressed air is heated by the electric heater, the consumption of oxygen and the increase in the carbonic acid gas are avoided, the indoor air is not harmed.

(2) Since heating is made not for the whole of the indoor air, but for a small quantity of compressed air sent into the compressed air heater, the amount of consumption of electricity can be made small, which contributes to energy saving and the sharp reduction of the fuel cost.

(3) Since the surface temperature of the steel pipe is made markedly higher than that obtained by means of hot water or steam, the indoor temperature can be raised in a short time to a temperature suitable for heating.

(4) Since the outside air can be sent into the green house when the present invention is embodied for heating inside of this house for growing vegetables or other farm products, it is unnecessary to provide ventilating equipment and, in addition, it is possible to facilitate production of the farm products in the same environment as in outdoor culture and to make a contribution to supplying low-cost products.

What is claimed is:

1. (Twice amended) A heat generating electromechanical system for an enclosure, said system defining a heating supply route, comprising:

a) an air compressor in said supply route;

b) a compressed air heater connected to the air compressor in said supply route;

c) electric heating means in said compressed air heater to heat said compressed air;

d) uninsulated pipe means in said compressed air route, connected to said compressed air heater, extending through an enclosure to be heated;

e) a compressed air exhaust port at the end of said uninsulated pipe means;

f) a water tank receiving said exhaust port to keep the compressed air in said uninsulated pipe means at a pressure greater than atmospheric pressure;

g) said water tank being continuously filled with water; and h) said exhaust port being continuously immersed a predetermined depth within said water;

whereby heat generated is conducted to the pipe wall and radiated to the enclosure to be heated through which the uninsulated pipe means passes.

2. A system as claimed in claim 1, including a thermostat in said enclosure with lower and upper temperature limit setting means; a solenoid valve with valve means electrically coupled to said thermostat, in the supply route of the compressed air to open and close said valve means in response to signals from said thermostat.

3. A system as claimed in claim 2, wherein the diameter of the uninsulated pipe means gradually enlarges from the inlet to the exhaust side.

* * * * *